US009121164B1

(12) United States Patent
Babiarz

(10) Patent No.: US 9,121,164 B1
(45) Date of Patent: Sep. 1, 2015

(54) METHOD AND APPARATUS FOR FILLING IN-PLACE BULK CONTAINER SANDBAGS

(71) Applicant: Stacey A. Babiarz, Edgerton, WI (US)

(72) Inventor: Stacey A. Babiarz, Edgerton, WI (US)

( * ) Notice: Subject to any disclaimer, the term of this patent is extended or adjusted under 35 U.S.C. 154(b) by 0 days.

(21) Appl. No.: 14/260,838

(22) Filed: Apr. 24, 2014

(51) Int. Cl.
*E02F 3/407* (2006.01)
*E02F 3/348* (2006.01)

(52) U.S. Cl.
CPC ..... *E02F 3/407* (2013.01); *E02F 3/348* (2013.01)

(58) Field of Classification Search
CPC ... E02F 3/348; E02F 3/407; B65G 2812/0533
USPC ..... 414/725, 526; 37/903; 198/669, 675
See application file for complete search history.

(56) References Cited

U.S. PATENT DOCUMENTS

| | | | | |
|---|---|---|---|---|
| 349,390 | A * | 9/1886 | Gilbert et al. | 198/669 |
| 3,240,401 | A | 3/1966 | Kirschmann | |
| 3,552,346 | A * | 1/1971 | Garden | 141/72 |
| 4,055,255 | A | 10/1977 | Vasquez | |
| 5,004,022 | A * | 4/1991 | Carlsson | 141/114 |
| 5,385,403 | A | 1/1995 | Knight et al. | |
| 5,564,886 | A | 10/1996 | Emerson et al. | |
| 7,510,365 | B2 | 3/2009 | Babiarz | |

FOREIGN PATENT DOCUMENTS

| | | | |
|---|---|---|---|
| EP | 2226429 | A2 | 9/2010 |
| WO | 2007093329 | A1 | 8/2007 |

OTHER PUBLICATIONS

Webpage, Bucket Bagger Machine, <http://www.bucketbagger.com/index.html>, accessed Apr. 11, 2014.
Webpage, Bulk Bag Filler, that fills, <http://www.custom-packaging-products.com/products/komac-bulk-bag-fillers/>, downloaded Mar. 12, 2014.

* cited by examiner

*Primary Examiner* — Dean Kramer
(74) *Attorney, Agent, or Firm* — Stiennon & Stiennon

(57) ABSTRACT

A bucket for a skid loader has a screw auger with right-hand and left-hand auger fighting which meet in the center on a single shaft. Rotation of the shaft in one direction causes sand or other granular material in the bucket to move toward the end outlets for loading into conventional sandbags. Rotation of the shaft in the opposite direction advances the material in the bucket to the center where it is discharged through a bottom outlet into a bulk bag such as an FIBC bag which is supported on tubes suspended from the bucket on lines. A cover is releasably attached to the bucket to block the bottom outlet when a bulk bag is not being filled.

10 Claims, 2 Drawing Sheets

METHOD AND APPARATUS FOR FILLING IN-PLACE BULK CONTAINER SANDBAGS

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to equipment for filing in-place a flexible intermediate bulk container (FIBC) or bulk bag utilizing earthmoving equipment.

Sandbags have been used since at least the late 1700s. Sandbags are bags, typically of burlap, cotton and most commonly polypropylene, which are filled with sand or soil and used for flood control, the construction of military fortifications, and even for low-cost housing. Sandbags can be filled by hand or by equipment such as shown in my previous U.S. Pat. No. 8,100,301, issued Jan. 24, 2012, and U.S. Pat. No. 7,510,365 issued Mar. 31, 2009. Sandbags are typically constructed of circularly woven polypropylene and have dimensions of 14"×26" and are designed hold to in the neighborhood of 30-70 pounds of sand so as to be carried by a single person.

More recently so-called flexible intermediate bulk container (FIBC) bulk bags or big bags have been used as sandbags. FIBC bulk bags were originally developed as an industrial container made of flexible fabric for storing and transporting dry, flowable products, such as sand, fertilizer, and granules of plastic. These bulk bags are often made of thick woven polyethylene or polypropylene, either coated or uncoated, and typically measure approximately 36×36 or 45-48 inches in maximum dimension or diameter and vary in height from 35 to 80 inches. A bulk bag's capacity is typically about 2,000 lbs, but larger bags are also used. A bulk bag weighing only 5 to 7 pounds can contain over a ton of material. Bulk bags may have a spout off the top for loading and/or a spout on the bottom for unloading, or bags may have an open top with or without a portion of the bag which folds over the bag opening.

When used as sandbags to build a retaining structure, the bags are typically filled in a stand or by a special purpose front-end loader with a large opening in the bottom of the loader bucket which fills the bag as sand or rock is scooped into the loader bucket. The bags are then transported to the place of use.

What is needed is a bucket which can be mounted to lighter weight equipment such as a skid-steer loader which, in addition to supplying a feed to fill conventional sandbags, can load one or several buckets of material into a bulk bag positioned in its final resting place.

SUMMARY OF THE INVENTION

The present invention is a bucket for a skid loader which has a screw auger mounted in the back or bottom of the bucket. The screw auger has right-hand and left-hand auger fighting on a single shaft, so the right- and left-hand flights meet in the center of the shaft. Rotation of the shaft causes material e.g., sand, in the bucket to move toward the ends of the bucket when the shaft is rotated in one direction and towards the center of the bucket when the shaft is rotated in the other direction. The bucket has three outlets, one at each end of the bucket and the conveyor, and one at the bottom of the middle of the bucket. It is known to fill sandbags simultaneously from the outlets at the ends of a bucket with a screw auger having right-hand and left-hand auger flighting on a single shaft. But in this invention the rotation of the auger can be reversed to move material toward the center where an outlet at the bottom of the middle of the bucket is opened by removing a cover so that the material in the bucket, as it is moved toward the bottom outlet, pours through the bottom outlet into a bulk bag which is clipped in an open position to and below the bucket.

It is an object of the present invention to provide a sandbag loading apparatus which can load both tubular sandbags and bulk sandbags.

It is another object of the present invention to provide a piece of disaster relief equipment which can be rapidly configured to load conventional tubular sandbags and bulk bags weighing up to and over 2,000 pounds.

It is a further object of the present invention to provide a piece of equipment which can be conveniently and rapidly switched from filling conventional tubular sandbags to filling in-place bulk bags.

Further objects, features and advantages of the invention will be apparent from the following detailed description when taken in conjunction with the accompanying drawings.

DESCRIPTION OF THE PREFERRED EMBODIMENTS

Figure 1:
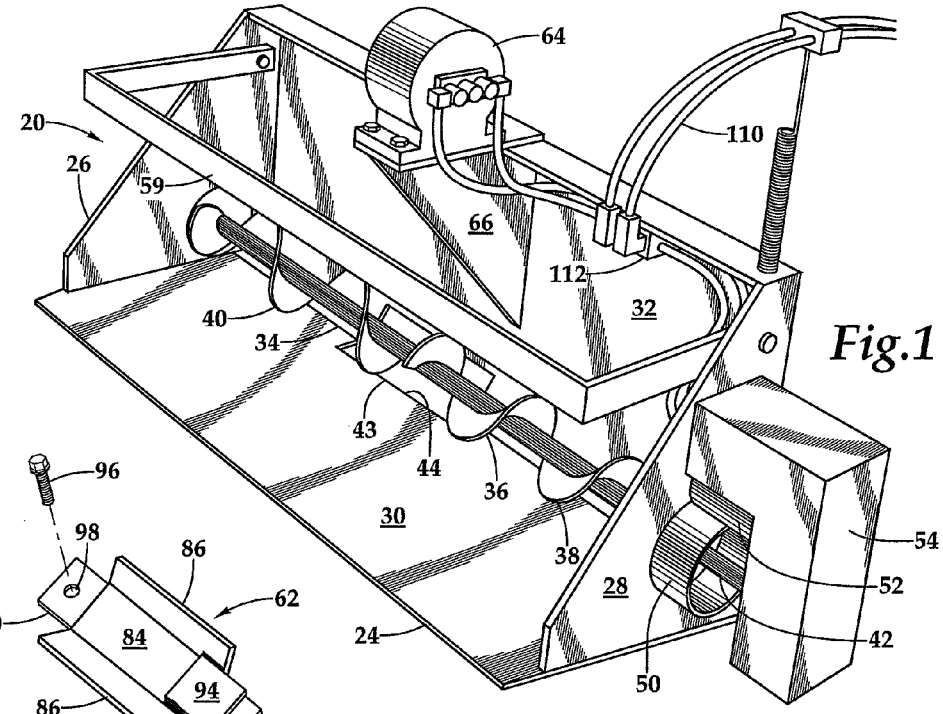
FIG. 1 is an isometric view of the skid loader bucket of this invention.
Figure 2:
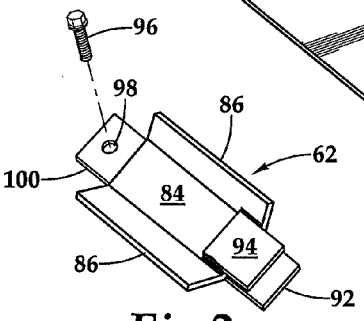
FIG. 2 is an isometric view of a removable cover for closing a bottom outlet in the bucket of FIG. 1.
Figure 3:
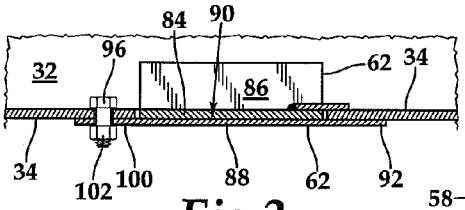
FIG. 3 is a fragmentary cross sectional view of the removable cover of FIG. 2 shown in position installed in the bottom outlet of the bucket of FIG. 1.
Figure 4:
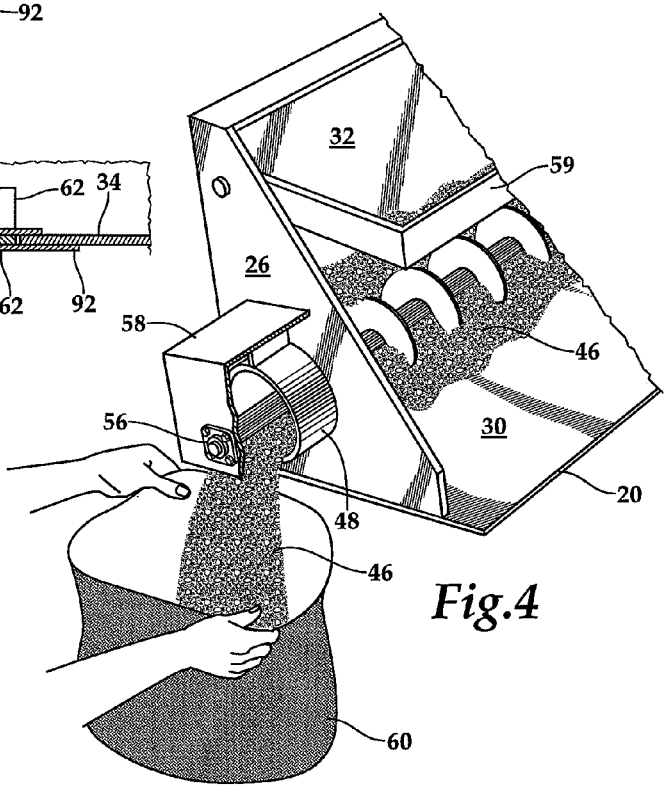
FIG. 4 is a fragmentary isometric view partially cut away in section showing the left side of the bucket of FIG. 1.
Figure 5:
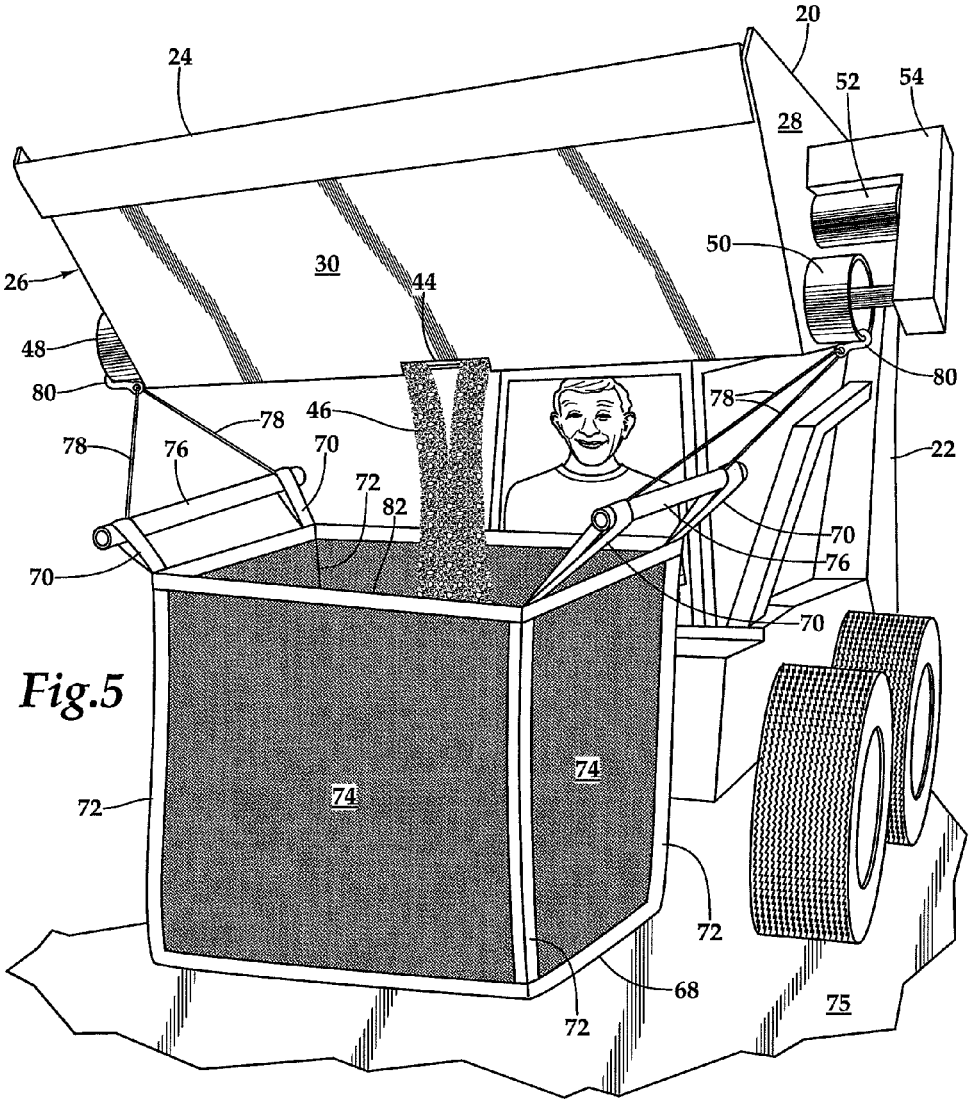
FIG. 5 is a perspective view of the bucket of FIG. 1 mounted to a skid loader and supporting and filling a bulk sandbag.

Referring more particularly to FIGS. 1-6. wherein like numbers refer to similar parts, a self-unloading bucket 20 is shown in FIGS. 1, 4, and 5 for use with and mountable to a skid loader 22 or a functionally similar vehicle as shown in FIG. 5. The self-unloading bucket 20 has certain similarities to my earlier U.S. Pat. No. 7,510,365 issued Mar. 31, 2009, the disclosure of which is incorporated herein by reference. As shown in FIG. 1, the self-unloading bucket 20 has a bucket shell 24 having a bucket volume defined by a left triangular end 26, a right triangular end 28, and a load plate 30 and a back plate 32 which extend between the triangular ends and which meet at the short angle plate 34, as shown in FIG. 3. As shown in FIG. 1, a double handed auger 36 is mounted within the bucket shell 24. The auger 36 has a right-handed portion 38 and a left-handed portion 40 which meet in the center of a drive shaft 42 which is suspended between the left triangular end 26 and the right triangular end 28 of the bucket shell 24.

Rotation of the double handed auger 36 serves to move material in the bucket shell 24 either toward the ends 26, 28 of the bucket shell or toward the center of the bucket shell depending on the direction of rotation of the drive shaft 42.

In the center 43 of the bucket shell is a central opening or outlet 44 through which material 46 falls, as shown in FIG. 5, when the drive shaft 42 is rotated such that material is moved to the center 43 of the bucket shell 24. When the drive shaft 42 is rotated in the opposite direction, material 46 is moved toward the left and right triangular ends 26, 28 of the bucket shell where the material passes through left and right cylindrical outlets 48, 50, shown in FIGS. 4 and 1, which are welded to and extend from the left and right triangular ends respectively. As shown in FIG. 1, the drive shaft 42 is driven by a hydraulic drive motor 52 mounted to the right triangular end 28 of the bucket shell. The motor 52 is connected by a chain drive to a drive sprocket (not shown) which incorporates a bearing (not shown) which are underneath the protective covering and bearing support 54 shown in FIGS. 1 and 5. As shown in FIG. 4, the drive shaft 42 is supported on the left triangular end 26 of the bucket shell 24 by a bearing 56 which is supported by a bracket 58 positioned above the left cylindrical outlet 48. As shown in FIG. 1, in addition to the guard 54, the bucket 20 has a safety bar 59 which is pivotally mounted to the triangular ends 26, 28 of the bucket shell 24 to guard the auger 36, and can be pivoted out of the way when loading the bucket, or locked in place with opposed locking nuts at the pivots, when conventional sandbags are being filled.

When the drive shaft is operated so as to move material to the left and right cylindrical outlets 48, 50, tubular sandbags 60 can be held beneath the openings and rapidly filled in a manner such as disclosed in my earlier U.S. Pat. No. 7,510,365. When filling conventional sandbags 60 a cover 62 shown in FIGS. 2, and 3 is placed in the central opening 44 and a hydraulic vibrator 64, shown in FIG. 1, mounted to a flange bracket 66 is operated to prevent the material 46 in the bucket shell 24 from bridging across the auger.

When the drive shaft 42 is turned so as to move material toward the center 43 of the bucket shell 24, the cover 62 is removed and the vibrator 64 is prevented from operation.

A bulk bag 68, i.e., a flexible intermediate bulk container or (FIBC) bag, is characterized by a generally rectangular shape and four straps 70 formed by a loop of woven material and attached to each of the four corners 72 formed where side wall panels 74 come together to form the bulk bag. As shown in FIG. 5, the bulk bag 68 is supported on a surface i.e., the ground 75, and at the same time on the bucket 20 by two support members, e.g., metal tubes 76 which are longer than the width of the bag, e.g., about 56-70 in. Each tube 76 is passed through two of the loops of two straps 70 on the same side of the bulk bag 68. Each tube 76 is supported by two ropes 78 which are attached to J-hooks 80 which are hooked on the lower rim of either the right or the left cylindrical outlets 48, 50. The tubes 76 support the bulk bag 68 in an open position with the open top 82 of the bulk bag beneath the self-unloading bucket 20 so the material 46 from the bucket shell 24 can drain into the bulk bag from the central outlet 44. The loops formed by the straps 70 are supported on the tubes 76 between the ends of the tubes 76 and the attachment points where the ropes 78 join the tubes 76.

The self-unloading bucket 20 for a skid unloader 22 holds about 11-13 $ft^3$ or about 1,400 to 1,700 lbs of sand. A FIBC bag 74 having a maximum dimensions or diameter of 44 inches and a height of 35 inches has a volume of about 30 $ft^3$ and so requires 2-3 bucket loads of sand or about 4,000 lbs of sand. Larger bags require even more fill material. Although large heavy equipment capable of filling and transporting a FIBC bag are known, such large special-purpose equipment is not cost-effective and it is not likely to be available or even operable in the environment of flood control. The self-unloading bucket 20 allows the use of a FIBC bags which are positioned in their final resting place and connected multiple times to the self-unloading bucket 20 until they are filled in place. In any given community skid loaders e.g. Bobcats® are used for many purposes from landscaping and snow removal to road construction, utility maintenance, and ditching. The self-unloading bucket 20 can be pre-positioned or rapidly transported to a natural disaster site and, when needed, the self-unloading bucket 20 can be connected to an available skid loader and used to fill conventional sandbags or FIBC bags to build retaining walls and flood control barriers using locally available materials such as sand and gravel and subsoil.

To convert the self-unloading bucket 20 for use in filling conventional sandbags 60 as shown in FIG. 4, the cover 62 is replaced in the outlet 44 and the direction of rotation of the shaft 42 is reversed. The cover 62, as shown in FIG. 2, has a rectangular part 84 which covers the outlet 44 in the angle plate 34. The rectangular part 84 of the cover 62 has upwardly angled side flanges 86 which match the angled load plate and back plate 30, 32 of the bucket shell 24. A lower mounting plate 88 is welded to the bottom side 90 of the rectangular part 84 to extend on either side of the rectangular part below the angle plate 34. A first part 92 of the mounting plate 88, as shown in FIG. 3, underlies a portion of the angle plate 34 and a small support plate 94 is welded to the top of the rectangular 84 to form a gap between the support plate and the first part 92 of the mounting plate 88 for receiving the angle plate 34 on one side of the outlet 44. The other side of the cover 62 is held to the angle plate 34 by a bolt 96 which pass through a hole 98 in a second part 100 of the mounting plate 88, and through a hole (not labeled) in the portion of the angle plate which overlies the second part. The bolt 96 has a nut 102 which when tightened clamps the mounting plate 88 to the angle plate 34.

Figure 6:
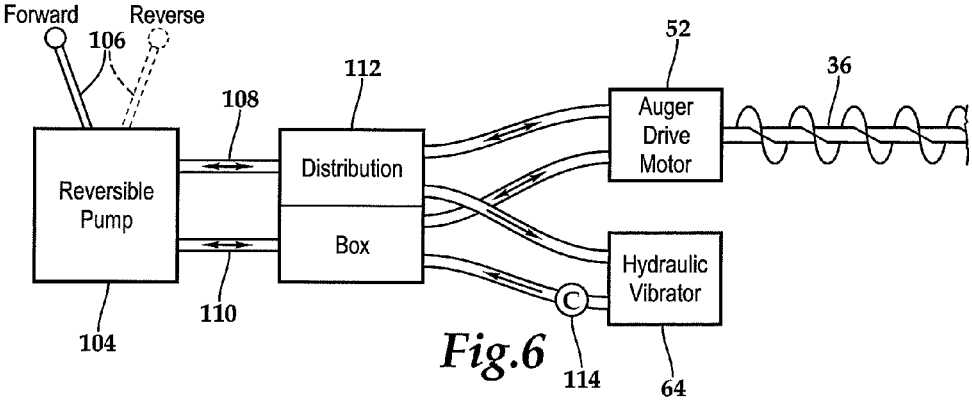
FIG. 6 is a schematic view of the hydraulic system which operates a screw drive motor and the hydraulic vibrator shown in the device of FIG. 1.

The skid loader 22 has a reversible hydraulic pump 104, shown in FIG. 6, with an control actuator 106 for changing the direction of flow in two hydraulic lines 108, 110. The hydraulic lines 108, 110 connect to a distribution box 112 which supplies hydraulic fluid to the screw drive motor 52 which turns the auger drive shaft 42. When the actuator 106 is in the forward position as shown in FIG. 6, the distribution box 112 also supplies hydraulic fluid to the vibrator 64 when the auger 36 is driven so as to move material 46 to the left and right cylindrical outlets 48, 50. When the actuator 106 is in the reverse position as shown in FIG. 6, the auger motor is reversed and the auger moves material to the central opening 44, and a check valve 114 prevents hydraulic fluid from flowing to the vibrator 64.

It should be understood that the right-handed portion 38 and the left-handed portion 40 of the auger may be reversed, in which case the direction in which the motor 52 is driven is also reversed in order to drive material toward or away from the central outlet 44 and the hydraulic lines to the vibrator 64 will also be reversed so the vibrator is only driven when the materiel is supplied to the cylindrical outlets 48, 50.

A bulk bag 68 i.e., a flexible intermediate bulk container (FIBC) or big bag or bulk sack, is defined as an intermediate bulk container, having a body made of high-strength lightweight flexible fabric such as polyolefin or polypropylene, and which weighs less than 1%, or more typically about 0.3% to 0.2% of the material they contain, which cannot be handled manually when filled, i.e a weight when filled of over about 500 lbs or more generally between 0.5 and 3 metric tons with a volume of up to 3 $m^3$, and which is used for solid material in powder, flake, or granular form, and does not require further packaging and is constructed to be lifted from the top by means of integral, permanently attached devices such as lift loops or straps. The normal filled maximum dimension or diameter of FIBCs is 45-48 in. with a height 35 to 80 inches. Alternatively FIBCs can be constructed of heavy-duty PVC-coated nylon or polyester where the cut sheets are welded together with integrated lift slings around the container so formed and arranged to be filled from the top.

It is understood that the invention is not limited to the particular construction and arrangement of parts herein illustrated and described, but embraces all such modified forms thereof as come within the scope of the following claims.

I claim:

1. A self-unloading bucket comprising:

a bucket shell having two ends and a middle portion therebetween;

sandbag outlets formed in each of the ends of the bucket shell;

an FIBC bag outlet formed in the middle portion of the bucket shell;

a double handed auger mounted within the bucket shell between the sandbag outlets, and passing over the FIBC outlet;

wherein the auger has a right-handed auger blade portion and a left-handed auger blade portion which extend to or meet over the FIBC outlet of the bucket;

a reversible motor mounted to the bucket shell and in driving relation to the double handed auger so that the auger moves material in the bucket shell either toward the ends of the bucket shell and the sandbag outlets formed therein or toward the middle portion of the bucket shell and the FIBC outlet formed therein, depending on the direction of rotation of the auger;

further comprising a cover for the FIBC outlet releasably mountable to the bucket shell to close the FIBC outlet and prevent the escape of material therethrough from the bucket;

wherein the cover for the FIBC outlet further comprises:

a rectangular plate having two long edges and two shorter edges, an upper side and a lower side and upwardly angled side flanges joined thereto;

a mounting plate joined to the bottom side of the rectangular plate and extending beyond the short edges on either side of the rectangular plate;

a first part of the mounting plate overlain by a first portion of the bucket shell;

a support plate joined to the rectangular plate and extending over the first part of the mounting plate to form a gap between the support plate and the first part of the mounting plate, which captures the first portion of the bucket shell which overlies the first part of the mounting plate;

a second part of the mounting plate opposite in relation to the first part, the second part overlain by a second portion of the bucket shell; and a member passing through the second part of the mounting plate and the second portion of the bucket shell which overlies the second part of the mounting plate to releasably affix the cover to the bucket shell.

2. A self-unloading bucket comprising:

a bucket shell having two ends and a middle portion therebetween;

sandbag outlets formed in each of the ends of the bucket shell;

an FIBC bag outlet formed in the middle portion of the bucket shell;

a double handed auger mounted within the bucket shell between the sandbag outlets, and passing over the FIBC outlet;

wherein the auger has a right-handed auger blade portion and a left-handed auger blade portion which extend to or meet over the FIBC outlet of the bucket;

a reversible motor mounted to the bucket shell and in driving relation to the double handed auger so that the auger moves material in the bucket shell either toward the ends of the bucket shell and the sandbag outlets formed therein or toward the middle portion of the bucket shell and the FIBC outlet formed therein, depending on the direction of rotation of the auger;

wherein the reversible motor mounted to the bucket shell is a reversible hydraulic motor, and further comprising:

a hydraulic vibrator mounted to the bucket shell;

a hydraulic circuit which connects the hydraulic motor and the hydraulic vibrator to a reversible hydraulic pump; and a check valve connected between the reversible hydraulic pump and the hydraulic vibrator which blocks a flow of hydraulic fluid when the hydraulic pump is connected to rotate the double handed auger so that the auger moves material in the bucket shell toward the middle portion of the bucket shell and the outlet formed therein.

3. A self-unloading bucket comprising:

a bucket shell having two ends and a middle portion therebetween;

sandbag outlets formed in each of the ends of the bucket shell;

an FIBC bag outlet formed in the middle portion of the bucket shell;

a double handed auger mounted within the bucket shell between the sandbag outlets, and passing over the FIBC outlet;

wherein the auger has a right-handed auger blade portion and a left-handed auger blade portion which extend to or meet over the FIBC outlet of the bucket;

a reversible motor mounted to the bucket shell and in driving relation to the double handed auger so that the auger moves material in the bucket shell either toward the ends of the bucket shell and the sandbag outlets formed therein or toward the middle portion of the bucket shell and the FIBC outlet formed therein, depending on the direction of rotation of the auger;

further comprising an FIBC bag having a bottom with sides extending upwardly from the bottom to an open top, wherein the bag bottom engages a surface, and wherein the bag is supported on the bucket shell by four straps connected to the FIBC bag sides, the FIBC bag top being open to receive material discharged from the bucket shell through the FIBC bag outlet.

4. The bucket of claim 3 wherein the FIBC bag straps form loops, and the FIBC bag defines a first width between the support straps, and further comprising:

two first support members which are longer than the first width, each first support member passing through two loops formed by two of the straps on the FIBC bag; and wherein each first support member is supported by two second support members which are spaced apart at their attachment to the first support member but which come together to form one of two releasable attachment members which engages the bucket shell at a location spaced from the FIBC bag outlet, the two releasable attachment members being spaced on opposite sides of the FIBC bag outlet.

5. A self-unloading bucket comprising:

a bucket shell having two ends and a middle portion therebetween;

sandbag outlets formed in each of the ends of the bucket shell;

a bulk bag having sides extending to an open top;

four straps connected to the sides on the bulk bag, the straps extending to the bucket shell to support the bulk bag on the bucket shell;

a bulk bag outlet formed in the middle portion of the bucket shell;

wherein the bulk bag top is positioned to receive material discharged from the bucket shell through the bulk bag outlet;

a double handed auger mounted within the bucket shell between the sandbag outlets, and passing over the bulk bag outlet;

wherein the auger has a right-handed auger blade portion and a left-handed auger blade which extend to or to meet above the bulk bag outlet of the bucket; and a reversible motor mounted to the bucket shell and in driving relation to the double handed auger to rotate the auger in either a first direction to drive the auger to move material in the bucket shell toward the sandbag outlets in the ends of the bucket shell or to rotate the auger in a second direction to move material in the bucket shell toward the bulk bag outlet in the middle portion of the bucket shell.

6. The bucket of claim 5 wherein the bulk bag engages a surface and wherein each bulk bag strap has a loop formed therein, and wherein the four straps comprise two pairs of straps, each strap in one of the strap pairs being spaced apart from the other strap at least a first distance;

two first support members having a length greater than the first distance, each support member extending through the loops of one of the two pairs of straps on the bulk bag;

wherein each first support member is supported by two second support members which are attached at locations spaced apart on the first support member, the second support members coming together at a single releasable attachment member which engages the bucket shell at a position spaced from the bulk bag outlet, such that the releasable attachment members are spaced on opposite sides of the bulk bag outlet.

7. The bucket of claim 5 wherein the bulk bag outlet further comprises:

a cover for the bulk bag outlet releasably mountable to the bucket shell.

8. The bucket of claim 7 wherein the cover for the bulk bag outlet further comprises:

a rectangular plate having two long edges and two shorter edges, an upper side and a lower side, and upwardly angled side flanges joined thereto;

a mounting plate joined to the bottom side of the rectangular plate and extending beyond the short edges on either side of the rectangular plate;

a first part of the mounting plate overlain by a first portion of the bucket shell;

a support plate joined to the rectangular plate and extending over the first part of the mounting plate to form a gap between the support plate and the first part of the mounting plate, which captures the first portion of the bucket shell which overlies the first part of the mounting plate;

a second part of the mounting plate opposite in relation to the first part, the second part being overlain by a second portion of the bucket shell;

a member passing through the second part of the mounting plate and the second portion of the bucket shell which overlies the second part of the mounting plate to releasably affix the cover to the bucket shell.

9. A self-unloading bucket comprising:

a self-unloading bucket having a bucket shell having two ends and a middle portion therebetween;

first outlets formed in each end of the bucket shell;

a second outlet formed in the middle portion of the bucket shell;

a double handed auger mounted within the bucket shell between the first outlets and passing over the second outlet, wherein the auger has a right-handed auger blade portion and a left-handed auger blade and which extend to overlie the second outlet;

a reversible motor mounted to the bucket shell and in driving relation to the double handed auger, the motor being connected to the auger to rotate the auger in a first direction so that the auger moves material in the bucket shell either toward the first outlets of the bucket shell or to rotate the auger in a second direction so that the auger moves material toward the middle portion of the bucket shell and the second outlet;

a bulk bag with sides extending downwardly from a bag top opening, portions of the bag engaging a supporting surface; and straps connected to the bulk bag sides, the straps extending from the bulk bag to connect it to the bucket shell, the bulk bag top opening being positioned to receive material discharged from the bucket shell through the second outlet.

10. The bucket of claim 9 further comprising a cover for the second outlet releasably mountable to the bucket shell.

* * * * *